US010953456B2

(12) United States Patent
Kitamoto et al.

(10) Patent No.: US 10,953,456 B2
(45) Date of Patent: Mar. 23, 2021

(54) BLADE CUTTING DEVICE AND BLADE CUTTING METHOD

(71) Applicants: SDS JAPAN CO. LTD., Saitama (JP); Koji Kitamoto, Osaka (JP)

(72) Inventors: Koji Kitamoto, Osaka (JP); In Bae Jung, Saitama (JP)

(73) Assignees: SDS JAPAN CO., LTD., Saitama (JP); KOJI KITAMOTO, Osaka (JP)

( * ) Notice: Subject to any disclaimer, the term of this patent is extended or adjusted under 35 U.S.C. 154(b) by 0 days.

(21) Appl. No.: 16/078,226

(22) PCT Filed: Feb. 24, 2016

(86) PCT No.: PCT/JP2016/055461

§ 371 (c)(1),
(2) Date: Aug. 21, 2018

(87) PCT Pub. No.: WO2017/145291

PCT Pub. Date: Aug. 31, 2017

(65) Prior Publication Data

US 2019/0022734 A1 Jan. 24, 2019

(51) Int. Cl.

| | |
|---|---|
| ***B21D 53/64*** | (2006.01) |
| ***B21D 43/28*** | (2006.01) |
| ***B21D 37/20*** | (2006.01) |

(52) U.S. Cl.

CPC ..... *B21D 53/64* (2013.01); *B21D 37/20* (2013.01); *B21D 37/205* (2013.01); *B21D 43/28* (2013.01); *B21D 43/287* (2013.01)

(58) Field of Classification Search

CPC .... B21D 53/64; B21D 37/205; B21D 43/287; B21D 43/24; B21D 53/62; B21D 28/02;
(Continued)

(56) References Cited

U.S. PATENT DOCUMENTS 4,474,092 A * 10/1984 Mally ..... B26D 7/0625 83/110
4,571,810 A * 2/1986 Leibinger ..... B07C 5/36 29/412
(Continued)

FOREIGN PATENT DOCUMENTS

CN 1334153 A 2/2002
EP 1129799 A1 9/2001
(Continued)

OTHER PUBLICATIONS

International Search Report cited in International Appln. No. PCT/JP2016/055461 dated Apr. 27, 2016.

*Primary Examiner* — Kenneth E Peterson
*Assistant Examiner* — Nhat Chieu Q Do
(74) *Attorney, Agent, or Firm* — Bacon & Thomas, PLLC

(57) ABSTRACT

A blade cutting device includes a material accommodation section having a plurality of accommodation chambers for accommodating the band-shaped materials used to form blades, in such a manner as to be sorted by type; a band-shaped material machining section having a feed unit for feeding a band-shaped material pulled out from a predetermined accommodation chamber and a cutting unit for cutting the band-shaped material into a predetermined length for forming blades; and a control section for causing the material accommodation section to move so as to locate the predetermined accommodation chamber at a position facing the band-shaped material machining section.

6 Claims, 12 Drawing Sheets

(58) Field of Classification Search
CPC ..... B21D 37/20; B21D 43/28; B23Q 7/046; B23Q 7/12; B65G 59/04; B65G 65/00
USPC ..... 76/104.1; 83/23, 61, 650, 102–167, 78; 72/338, 363
See application file for complete search history.

(56) References Cited

U.S. PATENT DOCUMENTS

| | | | | |
|---|---|---|---|---|
| 5,793,298 | A * | 8/1998 | Matsuura | B26D 5/00 270/58.07 |
| 8,419,415 | B2 * | 4/2013 | Sho | B26D 5/20 425/510 |
| 2001/0017074 | A1 | 8/2001 | Yamada | |
| 2016/0039119 | A1 * | 2/2016 | Sho | B29C 31/008 83/23 |

FOREIGN PATENT DOCUMENTS

| | | | | |
|---|---|---|---|---|
| EP | 1354648 | A1 * | 10/2003 | B21D 43/287 |
| JP | 2010-58042 | A | 3/1998 | |
| JP | 2001-314932 | A | 11/2001 | |
| JP | 2003_326331 | A | 11/2003 | |
| JP | 2003326331 | A * | 11/2003 | |
| JP | 2005-230883 | A | 9/2005 | |
| JP | 2005230883 | A * | 9/2005 | |

* cited by examiner

BLADE CUTTING DEVICE AND BLADE CUTTING METHOD

TECHNICAL FIELD

The present invention relates to a blade cutting device and a blade cutting method.

BACKGROUND ART

Conventionally, a container formed of a sheet material such as paperboard, corrugated cardboard, or the like is formed as follows: a blank having a shape corresponding to the structure of the container is stamped from a sheet material by a stamping machine, and the blank is bent into a predetermined shape.

The stamping machine includes an upper platen and a lower platen; a stamping die is attached to the upper platen, and a cutting plate is attached to the lower platen; a sheet material is placed on the cutting plate; and the upper platen is lowered and pressed against the lower platen, thereby forming a blank from the sheet material and forming ruled lines for bending on the blank.

Thus, the stamping die has grooves in a predetermined pattern; various stamping blades for cutting a sheet material into a blank, and various ruling blades for forming ruled lines for bending are embedded in the grooves; and the stamping blades have sharp edges formed at their lower ends, and the ruling blades have round edges formed at their lower ends.

Meanwhile, a blade cutting device is provided for forming the stamping blades and the ruling blades. In the blade cutting device, graphic data indicative of the shapes and dimensions of the stamping blades and the ruling blades are extracted from CAD data designed for stamping by a stamping machine, and, on the basis of the graphic data, band-shaped materials of metal are cut into the stamping blades and the ruling blades (see, for example, Patent Document 1).

PRIOR ART DOCUMENT

Patent Document

Patent Document 1: Japanese Patent Publication (kokoku) No. H07-36934

SUMMARY OF THE INVENTION

Problem to be Solved by the Invention

However, according to the above conventional blade cutting device, the stamping blades and the ruling blades must be formed one by one by cutting a band-shaped material specified in graphic data into a blade having dimensions specified in the graphic data; thus, the work of cutting the band-shaped materials is troublesome.

In the case of a blank having a complex shape, a blank having complex ruled lines formed thereon, or a like blank, the shape of grooves formed in the stamping die becomes complex, and the number of stamping blades and ruling blades embedded in the grooves increases. Therefore, not only does the number of types of stamping blades and ruling blade increase, but also the number of types of band-shaped materials increases.

Therefore, the work of selecting band-shaped materials for forming the stamping blades and the ruling blades from a large number of types of band-shaped materials becomes complicated, potentially resulting in a failure to accurately form the stamping blades and the ruling blades.

In such a case, proper embedment of the stamping blades and the ruling blades in the grooves of the stamping die fails, resulting in a failure to accurately form a blank.

The present invention has been conceived to solve the above problem involved in the conventional blade cutting device, and an object of the present invention is to provide a blade cutting device and a blade cutting method capable of simplifying the work of cutting band-shaped materials, and accurately forming blades.

Means for Solving the Problem

A blade cutting device of the present invention comprises: a material accommodation section comprising a plurality of accommodation chambers for respectively accommodating different types of band-shaped materials used to form blades; a band-shaped material machining section comprising a feed unit for feeding a band-shaped material pulled out from a predetermined one of the plurality of accommodation chambers and a cutting unit for cutting the fed band-shaped material into a predetermined length for forming blades; and a control section for causing the material accommodation section to move so as to locate the predetermined accommodation chamber of the material accommodation section at a position facing the band-shaped material machining section.

Effects of the Invention

According to the present invention, the blade cutting device comprises: a material accommodation section comprising a plurality of accommodation chambers for respectively accommodating different types of band-shaped materials used to form blades; a band-shaped material machining section comprising a feed unit for feeding a band-shaped material pulled out from a predetermined one of the plurality of accommodation chambers and a cutting unit for cutting the fed band-shaped material into a predetermined length for forming blades; and a control section for causing the material accommodation section to move so as to locate the predetermined accommodation chamber of the material accommodation section at a position facing the band-shaped material machining section.

In this case, different types of band-shaped materials used to form blades are respectively set in a plurality of the accommodation chambers of the material accommodation section; a predetermined one of the plurality of accommodation chambers is located at a position facing the band-shaped material machining section; a band-shaped material pulled out from the predetermined accommodation chamber is fed by the feed unit; and the cutting unit cuts the band-shaped material into a predetermined length for forming blades; therefore, the work of selecting a band-shaped material from a large number of types of band-shaped materials for forming blades can be simplified, and the blade can be formed accurately.

MODES FOR CARRYING OUT THE INVENTION

An embodiment of the present invention will next be described with reference to the drawings.

Figure 2:
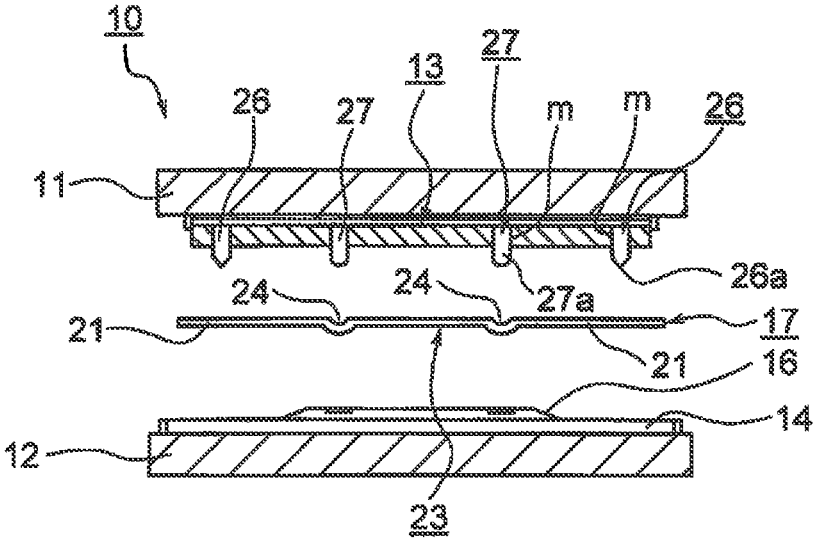
FIG. 2 Conceptual view of a stamping machine.

FIG. 2 is a conceptual view of a stamping machine.

In FIG. 2, 10 denotes a stamping machine; 11 denotes an upper platen; 12 denotes a lower platen; 13 denotes a stamping die attached to the upper platen 11; 14 denotes a cutting plate attached to the lower platen 12; and 16 denotes a face plate attached to the cutting plate 14.

A sheet material 17 such as paperboard, corrugated cardboard, or the like is placed on the face plate 16; the upper platen 11 is lowered and pressed against the lower platen 12, thereby stamping a blank 23 from the sheet material 17 along cutting lines 21 and forming ruled lines 24 for bending on the blank 23.

Thus, the stamping die 13 has grooves m formed therein in a predetermined pattern; stamping blades 26 serving as various first blades for stamping a blank from the sheet material 17 and ruling blades 27 serving as various second blades for forming the ruled lines 24 are embedded in the grooves m; and the stamping blades 26 have sharp edges 26*a* formed at lower ends thereof, and the ruling blades 27 have round edges 27*a* formed at lower ends thereof.

Incidentally, the stamping blades 26 and the ruling blades 27 are formed by cutting band-shaped materials of metal into predetermined lengths by use of a blade cutting device. In the case of the blank 23 having a complex shape, the blank 23 having the complex ruled lines 24, or a like blank, the shape of the grooves m formed in the stamping die 13 becomes complex, and the number of the stamping blades 26 and the ruling blades 27 increases, resulting in not only an increase in the number of types of the stamping blades 26 and the ruling blades 27, but also an increase in the number of types of band-shaped materials.

Accordingly, in the blade cutting device, the work of selecting band-shaped materials for forming the stamping blades 26 and the ruling blades 27 from a large number of types of band-shaped materials becomes complicated, potentially resulting in a failure to accurately form the stamping blades 26 and the ruling blades 27.

Thus, there will be described a blade cutting device of the present invention capable of simplifying the work of selecting blade-shaped materials and accurately forming the stamping blades 26 and the ruling blades 27.

Figure 1:
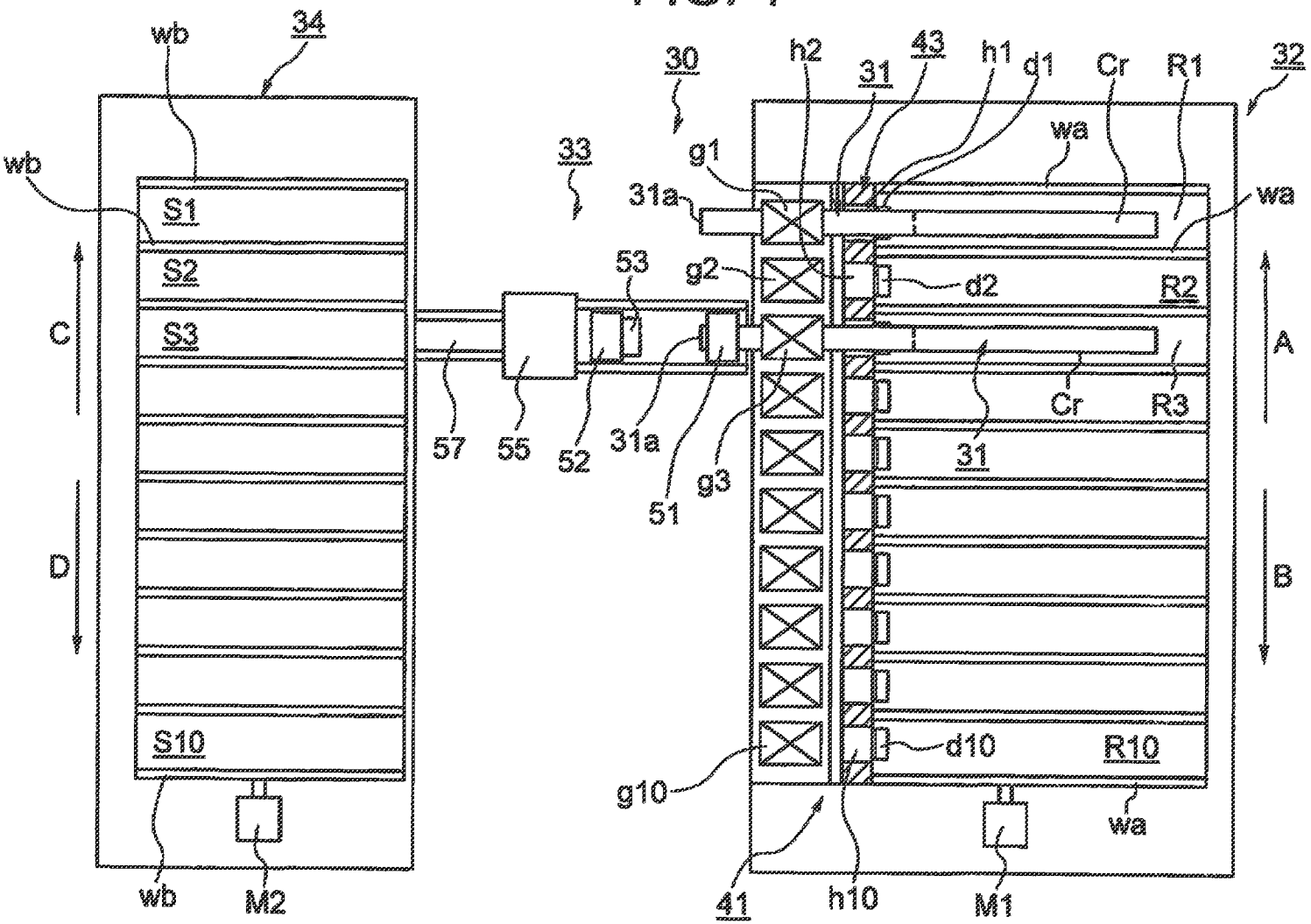
FIG. 1 Conceptual view of a blade cutting device in an embodiment of the present invention.
Figure 3:
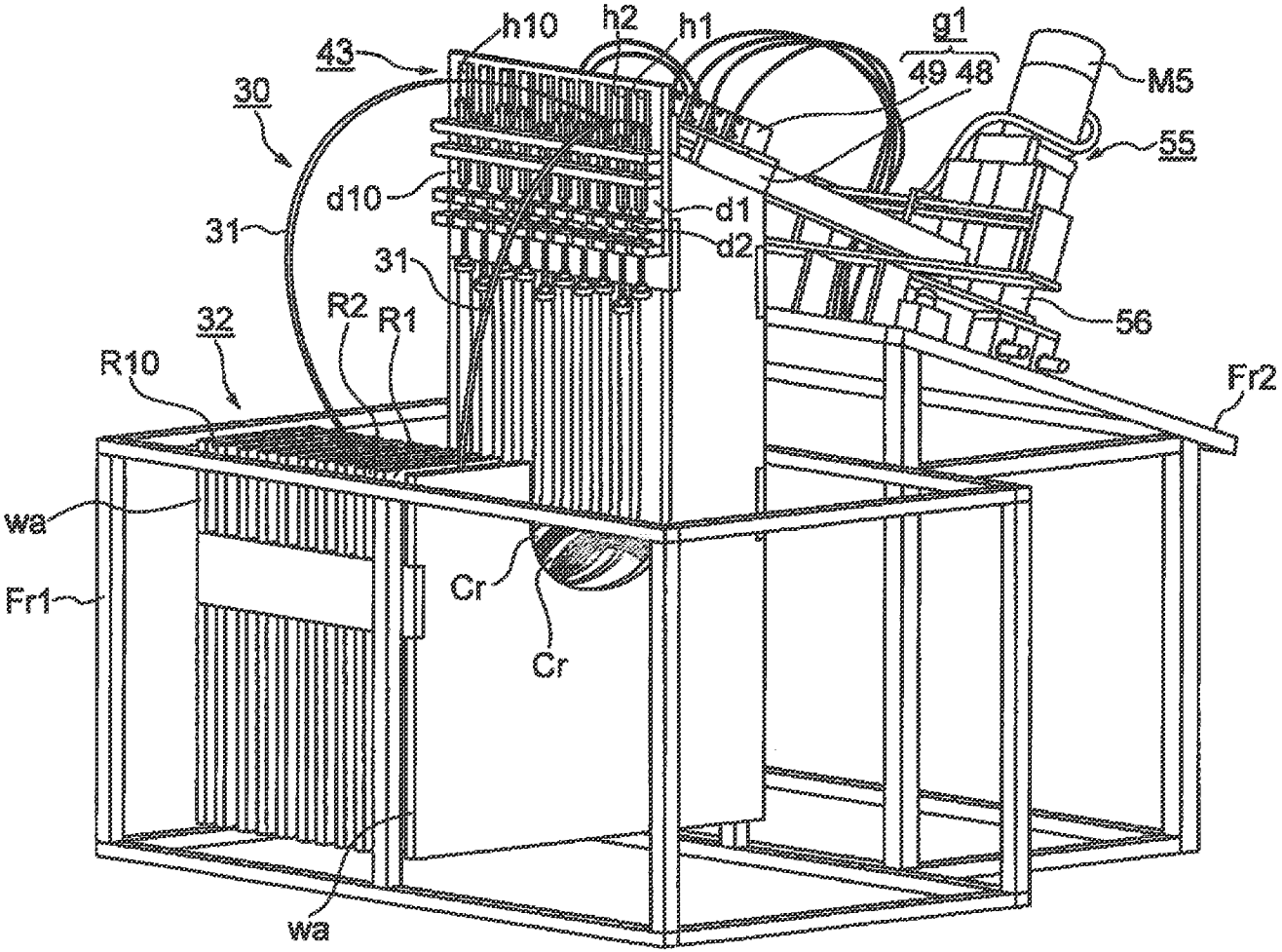
FIG. 3 Perspective view of the blade cutting device in the embodiment of the present invention.
Figure 4:
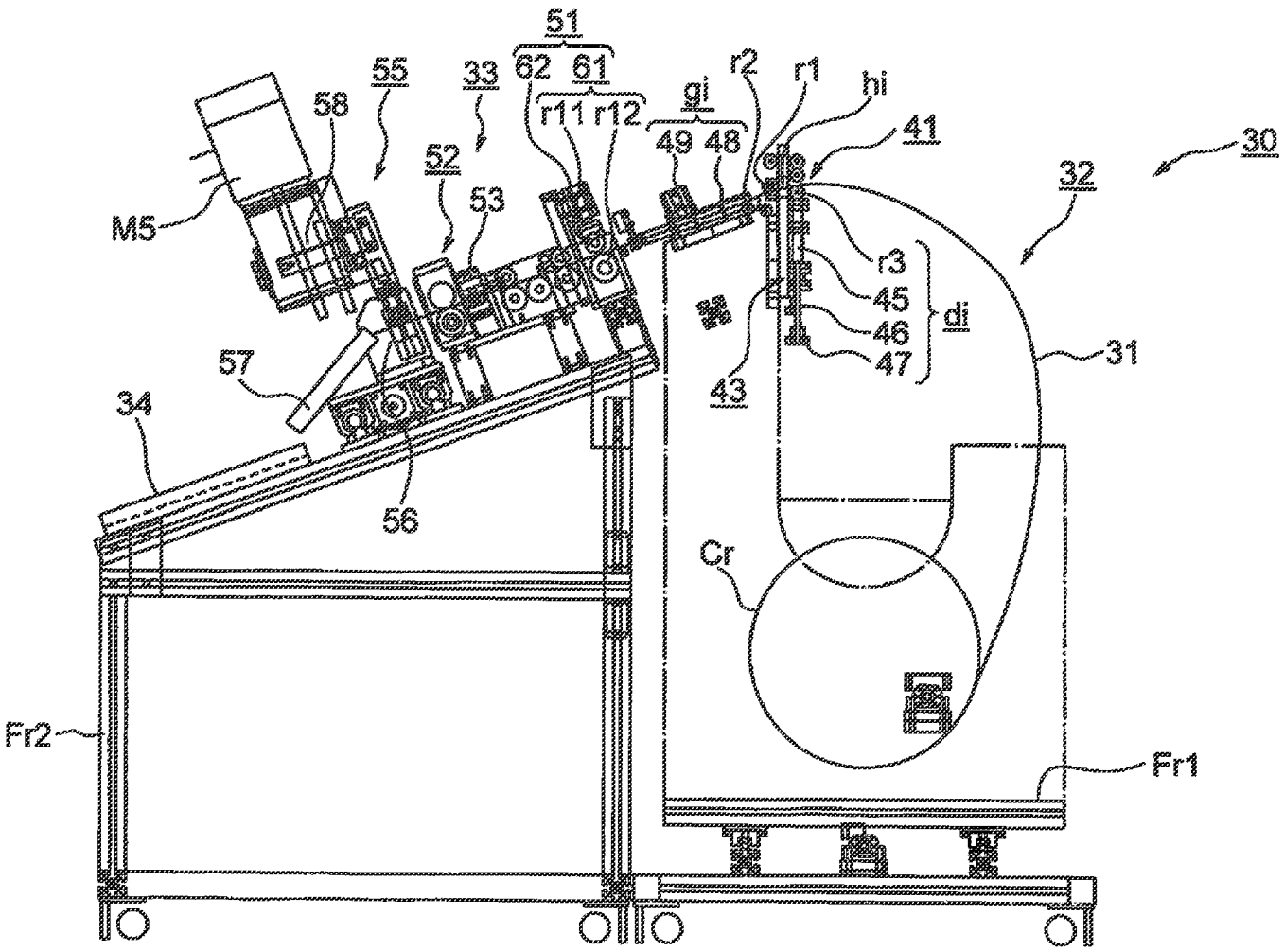
FIG. 4 Side view of the blade cutting device in the embodiment of the present invention.
Figure 5:
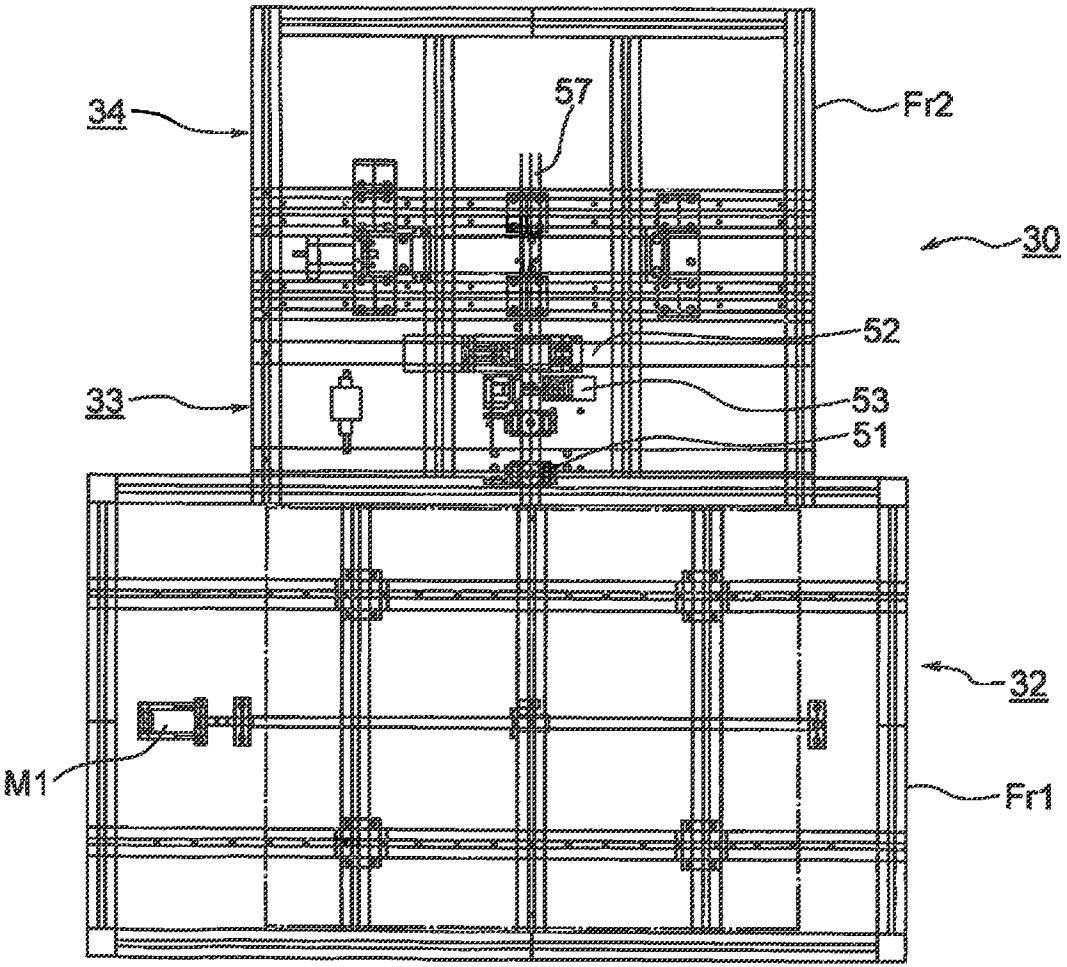
FIG. 5 Plan view of the blade cutting device in the embodiment of the present invention.
Figure 6:
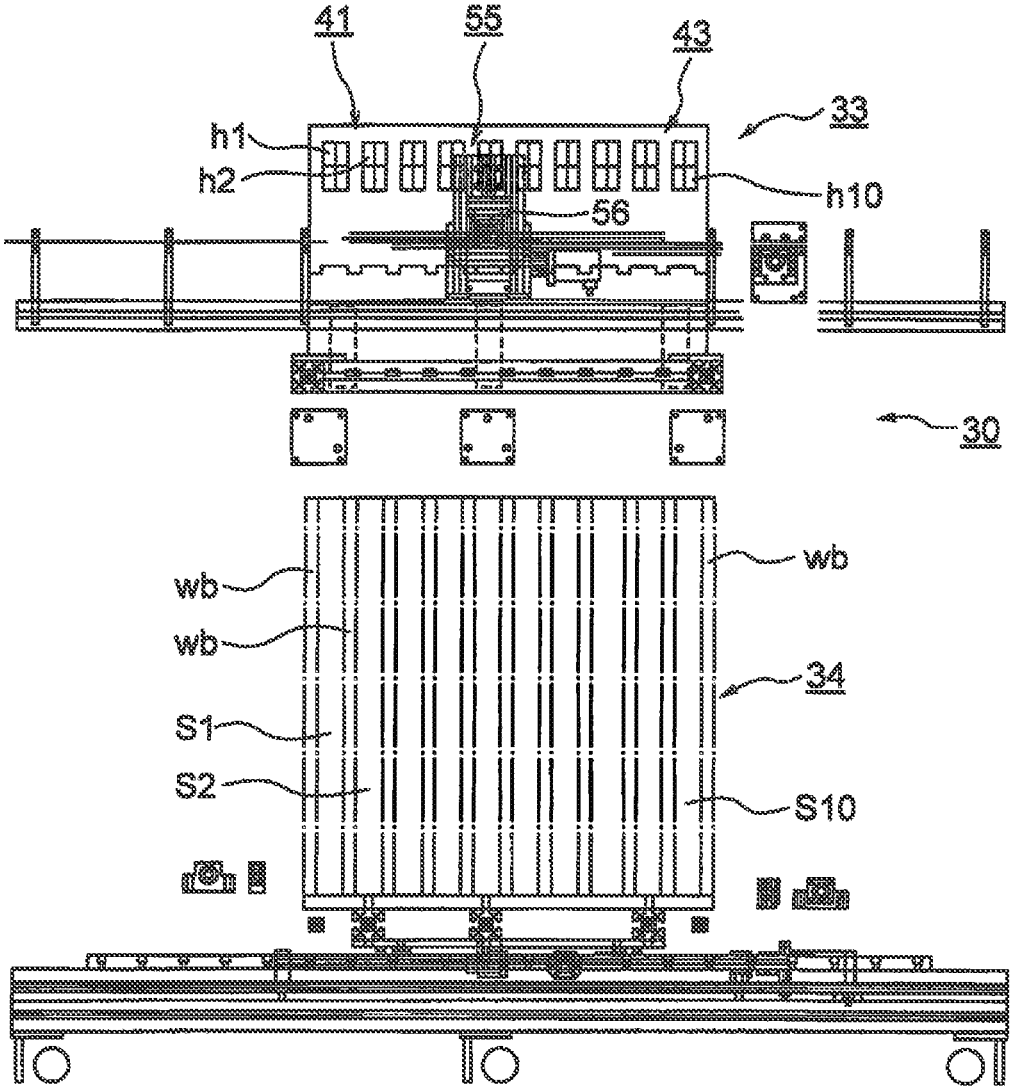
FIG. 6 Rear view of the blade cutting device in the embodiment of the present invention.
Figure 7:
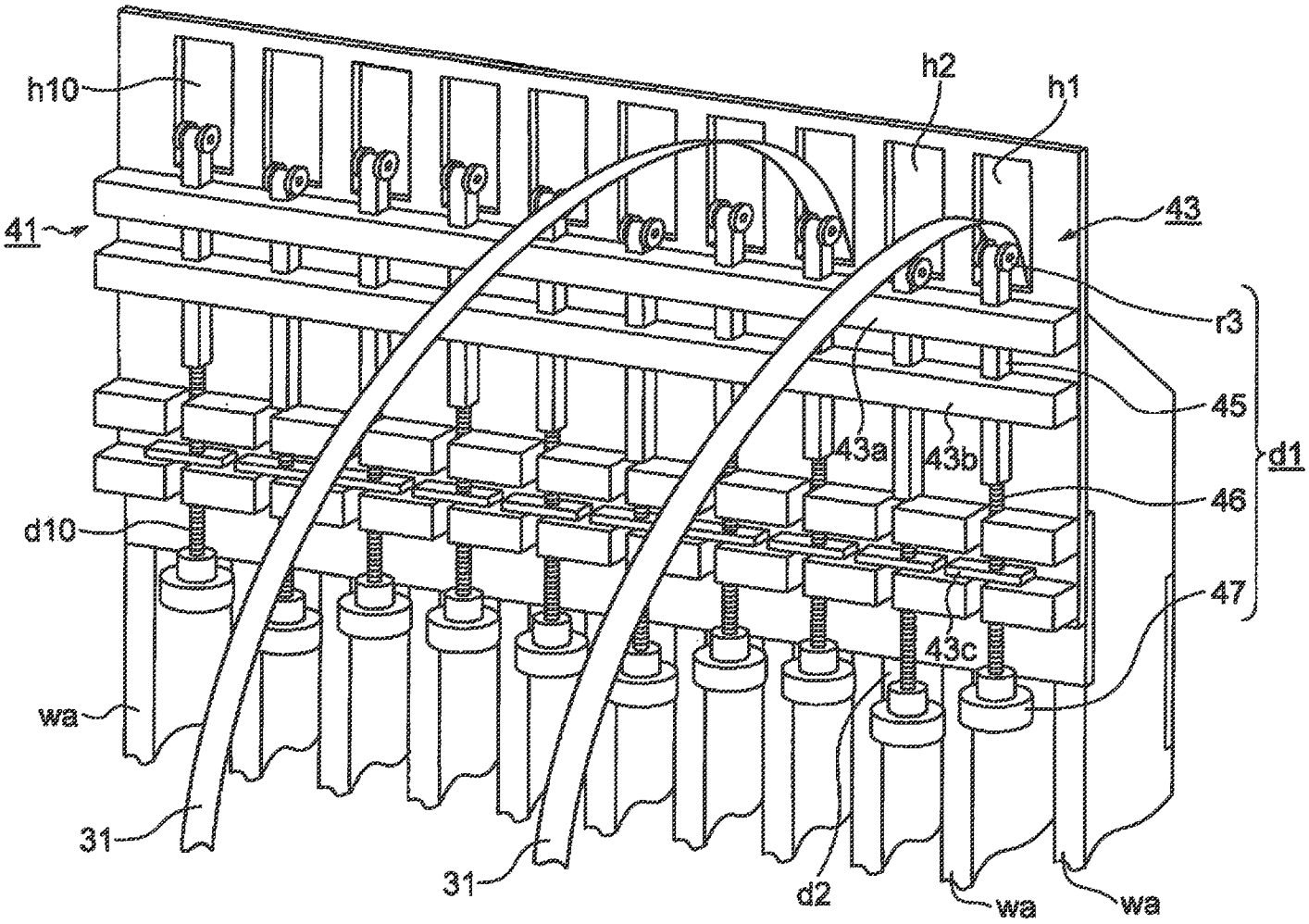
FIG. 7 Perspective view of a band-shaped material guide section in the embodiment of the present invention.
Figure 8:
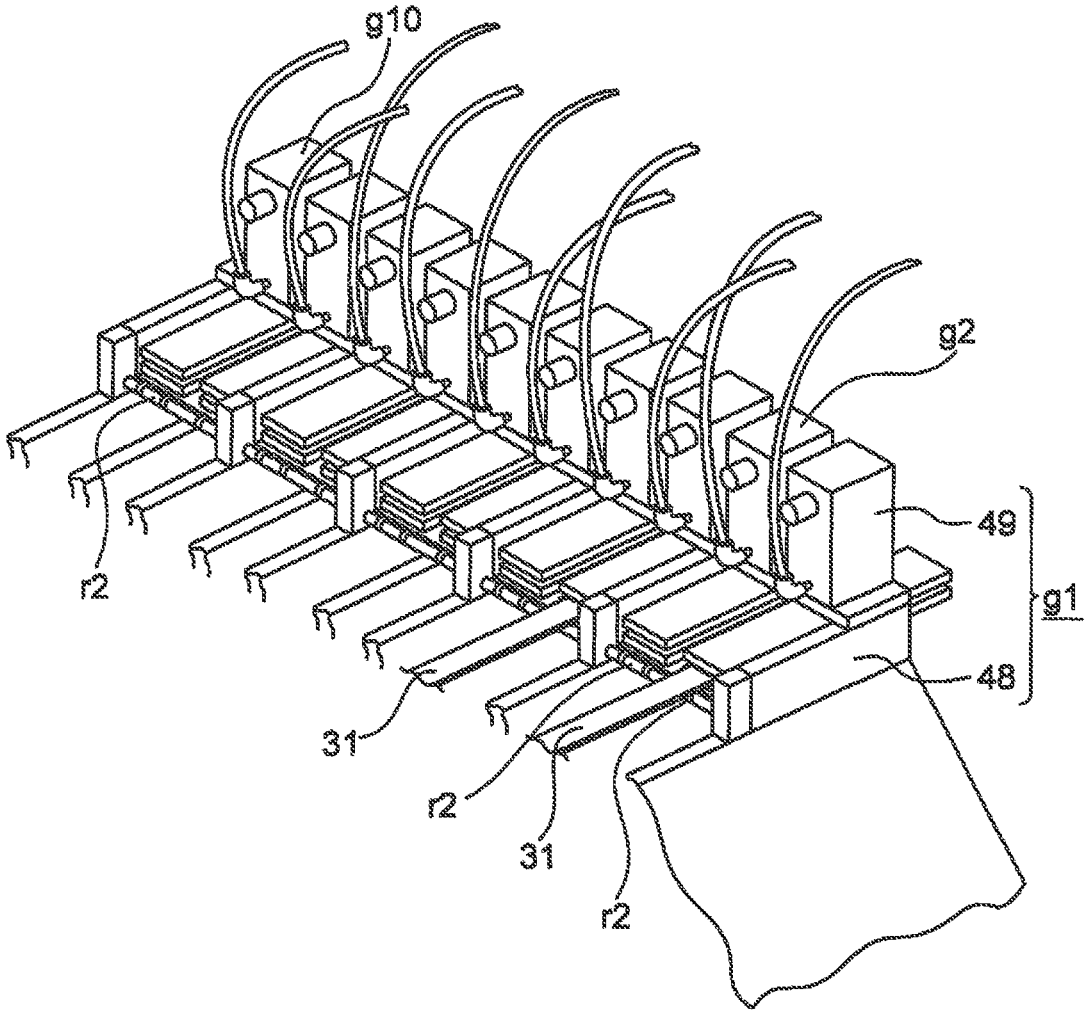
FIG. 8 Perspective view of essential portions of the band-shaped material guide section in the embodiment of the present invention.
Figure 9:
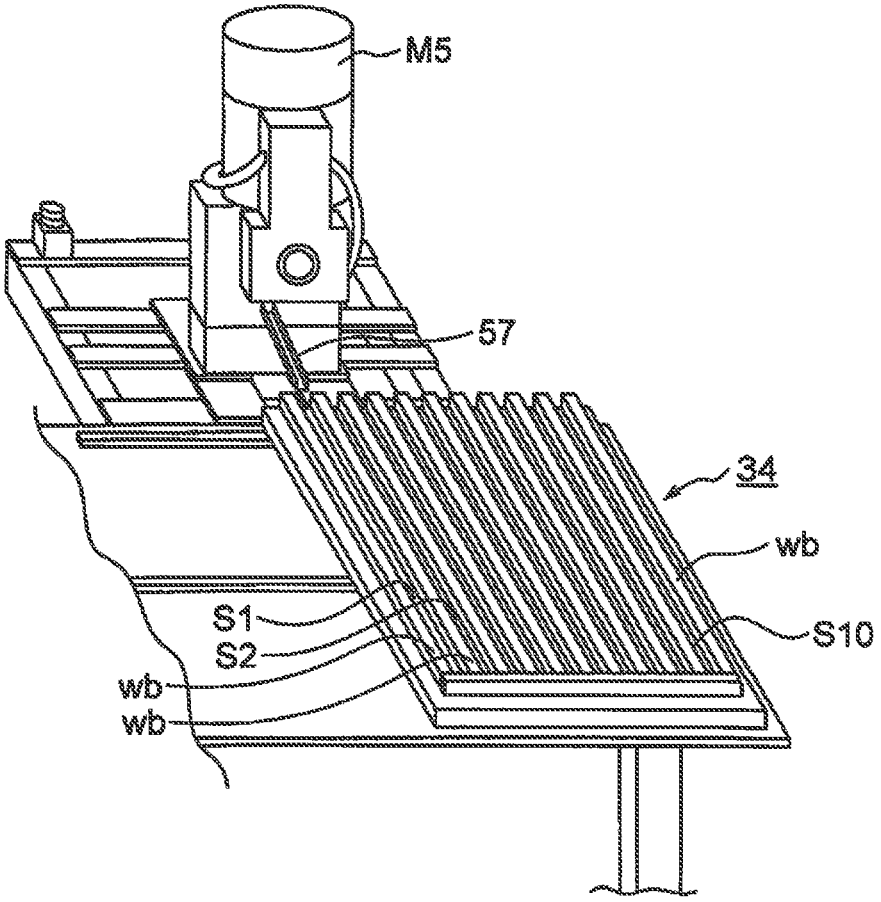
FIG. 9 Perspective view of a blade accommodation section in the embodiment of the present invention.
Figure 10:
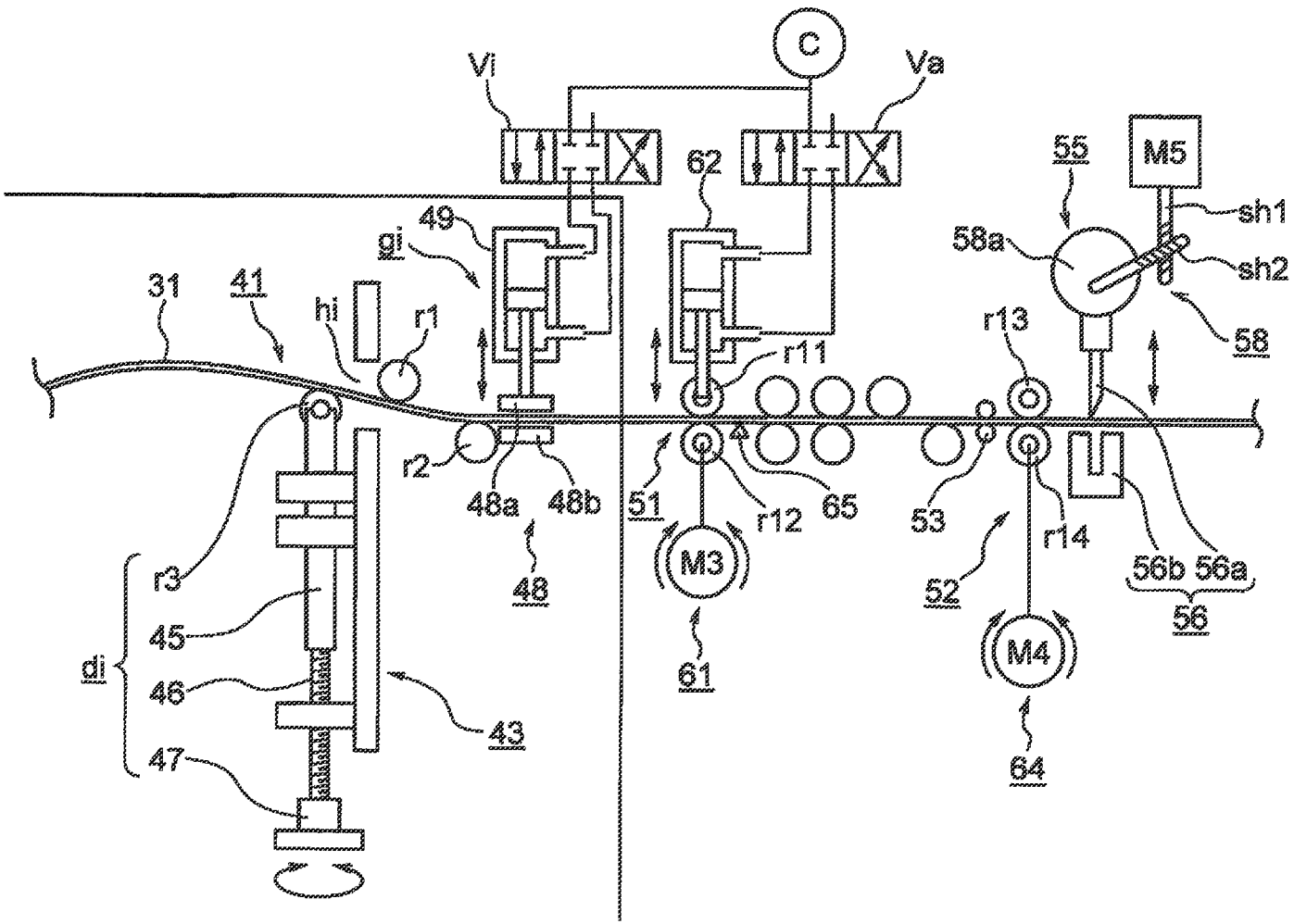
FIG. 10 Mechanism map of the blade cutting device in the embodiment of the present invention.

FIG. 1 is a conceptual view of a blade cutting device in an embodiment of the present invention; FIG. 3 is a perspective view of the blade cutting device in the embodiment of the present invention; FIG. 4 is a side view of the blade cutting device in the embodiment of the present invention; FIG. 5 is a plan view of the blade cutting device in the embodiment of the present invention; FIG. 6 is a rear view of the blade cutting device in the embodiment of the present invention; FIG. 7 is a perspective view of a band-shaped material guide section in the embodiment of the present invention; FIG. 8 is a perspective view of essential portions of the band-shaped material guide section in the embodiment of the present invention; FIG. 9 is a perspective view of a blade accommodation section in the embodiment of the present invention; and FIG. 10 is a mechanism map of the blade cutting device in the embodiment of the present invention.

In the drawings, 30 denotes a blade cutting device; 31 denotes a band-shaped material used to form stamping blades 26 (FIG. 2), ruling blades 27, etc.; 32 denotes a material accommodation section adapted to accommodate the band-shaped materials 31 and disposed in such a manner as to be movable in directions of arrows A and B in relation to a frame Fr1; 33 denotes a band-shaped material machining section fixed to a frame Fr2 and adapted to cut the band-shaped materials 31 into predetermined lengths to form blades; 34 denotes a blade accommodation section adapted to accommodate blades formed through cutting in the band-shaped material machining section 33, and disposed in such a manner as to be movable in directions of arrows C and D in relation to the frame Fr2; M1 denotes a motor serving as a drive section for moving the material accommodation section 32 in the directions of arrows A and B; and M2 denotes a motor serving as a drive section for moving the blade accommodation section 34 in the directions of arrows C and D. The motors M1 and M2 are synchronously driven; when the motors M1 and M2 are driven in the positive direction, the material accommodation section 32 is moved in the direction of arrow A, and the blade accommodation section 34 is moved in the direction of arrow C; and when the motors M1 and M2 are driven in the reverse direction, the material accommodation section 32 is moved in the direction of arrow B, and the blade accommodation section 34 is moved in the direction of arrow D.

The material accommodation section 32 includes a plurality of, 11 in the present embodiment, "U"-shaped partition walls wa standing in parallel with one another, and the partition walls wa define a plurality of, 10 in the present embodiment, accommodation chambers Ri (i=1, 2, . . . , 10). The accommodation chambers Ri respectively accommodate different types of rolled band-shaped materials 31; i.e., rolls (coils) Cr.

Incidentally, since the band-shaped materials 31 are accommodated in the material accommodation section 32 in the form of rolls Cr, the band-shaped materials 31 pulled out from the material accommodation section 32 are curled. Thus, the present embodiment includes a band-shaped material guide section 41 which is disposed at an end portion toward the band-shaped material machining section 33 of the material accommodation section 32, receives the band-shaped materials 31 pulled out from the accommodation chambers Ri, feeds and guides the band-shaped materials 31 to the band-shaped material machining section 33, and uncurls the band-shaped materials 31 in the course of feed.

The band-shaped material guide section 41 includes: a reception plate 43 extending in the width direction of the blade cutting device 30 and having a plurality of, 10 in the present embodiment, holes hi (i=1, 2, . . . , 10) formed therein in parallel, serving as reception ports, and corresponding to the accommodation chambers Ri; a plurality of, 10 in the present embodiment, position adjusting sections di (i=1, 2, . . . , 10) disposed on the upstream side of the reception plate 43 with respect to the feed direction of the band-shaped materials 31 in such a manner as to face the respective holes hi and in a vertically movable manner in relation to the reception plate 43, and adapted to adjust the positions of receiving the band-shaped materials 31 for the band-shaped material guide section 41; 10 rollers r1 disposed rotatably in such a manner as to correspond to the holes hi on the downstream side of the reception plate 43 with respect to the feed direction of the band-shaped materials 31, and serving as pressing members for pressing the band-shaped materials 31 from above so as to direct downward the feed direction of the band-shaped materials 31; 10 rollers r2 disposed rotatably in such a manner as to correspond to the rollers r1 on the downstream side of the rollers r1 with respect to the feed direction of the band-shaped materials 31, and serving as first support members for pressing the band-shaped materials 31 from underneath so as to support the band-shaped materials 31; and a plurality of, 10 in the present embodiment, gate sections gi (i=1, 2, . . . , 10) disposed adjacent to the rollers r2 in such a manner as to correspond to the accommodation chambers Ri and adapted to set the band-shaped materials 31 at standby positions and to guide the band-shaped materials 31 to the band-shaped material machining section 33.

The position adjusting sections di (i=1, 2, . . . , 10) include: bars 45 serving as movement support members disposed in a vertically movable manner in relation to the reception plate 43; 10 rollers r3 disposed rotatably at upper ends of the bars 45 and serving as second support members for supporting the band-shaped materials 31 by pressing the band-shaped materials 31 from underneath at predetermined vertical positions; screws 46 serving as position adjusting elements and disposed in contact with lower ends of the bars 45 in such a manner as to be rotatable in relation to the reception plate 43 and vertically movable; and knobs 47 disposed at lower ends of the screws 46 and serving as operating elements. Thus, an operator of the blade cutting device 30 can adjust the positions of the rollers r3 by turning the knobs 47 for rotating the screws 46 so as to vertically move the bars 45 and the rollers r3.

The reception plate 43 has retainer members 43*a* and 43*b* formed in a protruding manner, having holes for allowing the bars 45 extending therethrough, and retaining the bars 45 movably, and retainer members 43*c* formed in a protruding manner, having threaded holes threadingly engaged with the screws 46, and retaining the screws 46 rotatably and movably.

Incidentally, the rollers r1 to r3 are disposed along the feed direction of the band-shaped materials 31; the rollers r1 press the band-shaped materials 31 from above while rolling; the rollers r2 and r3 press the band-shaped materials 31 from underneath while rolling; accordingly, the band-shaped materials 31 can be uncurled while being fed.

The band-shaped materials 31 differ in intensity of curling, depending on type thereof; for example, material, thickness, width, etc. An operator operates the position adjusting section di so as to move the roller r3 to a predetermined position corresponding to the intensity of curling; as a result, since the height of a receiving position is adjusted, the band-shaped material 31 can be reliably uncurled in response to the type of the band-shaped material 31. The rollers r1 to r3 constitute an uncurling section for uncurling the band-shaped material 31. In the present embodiment, of the rollers r1 to r3, the roller r3 is adjusted in position; however, through adjustment of the position of either one of the rollers r1 and r2, the band-shaped material 31 can be uncurled in response to the type of the band-shaped material 31.

The gate sections gi set the band-shaped materials 31 at their standby positions located downstream of the rollers r1 with respect to the feed direction of the band-shaped materials 31 and are adapted to selectively guide the band-shaped material 31 pulled out from the predetermined accommodation chamber Ri to the band-shaped material machining section 33.

Thus, the gate sections gi include gates 48 for opening/closing feed passages for the band-shaped materials 31, and air cylinders 49 serving as actuators for driving the gates 48. The gates 48 each include plates 48*a* and 48*b* serving as a pair of gripping members and disposed in such a manner as to vertically come into contact with and separate from each other. The air cylinders 49 are connected to a compressor C serving as a medium supply through a plurality of, 10 in the present embodiment, selector valves Vi (i=1, 2, . . . , 10) disposed in such a manner as to correspond to the gate sections gi, and drive the gates 48 through reception of compressed air serving as working medium and sent from the compressor C to thereby vertically move the plates 48*a*.

When the plates 48*a* are moved to upper positions and separated from the plates 48*b*, the feed passages for the band-shaped materials 31 are opened so as to allow feed of the band-shaped materials 31. When the plates 48*a* are moved to lower positions and brought in contact with the plates 48*b*, the feed passages for the band-shaped materials 31 are closed, and the band-shaped materials 31 are gripped between the plates 48*a* and 48*b* and disabled from being fed. At this time, the band-shaped materials 31 are set at standby positions. Since the band-shaped materials 31 set at standby positions are gripped between the plates 48*a* and 48*b*, there can be prevented shifting of the band-shaped materials 31 from the standby positions, which could otherwise result from vibration generated in the blade cutting device 30, deadweight of the band-shaped materials 31, and the like.

The band-shaped material machining section 33 includes: a first feed unit 51 disposed in such a manner as to face one of the gate sections gi at an upstream end with respect to the feed direction of the band-shaped material 31 and adapted to feed one band-shaped material 31 pulled out from a predetermined accommodation chamber Ri and selectively guided by a relevant gate section gi; a second feed unit 52 disposed downstream of the first feed unit 51 with respect to the feed direction of the band-shaped material 31 and adapted to feed the band-shaped material 31; an encoder 53 disposed adjacent to the second feed unit 52 between the first and second feed units 51 and 52 and serving as a feed amount detection section for detecting the amount of feed of the band-shaped material 31; a cutting unit 55 disposed adjacent to the second feed unit 52 on the downstream side of the second feed unit 52 with respect to the feed direction of the band-shaped material 31 and adapted to cut the band-shaped material 31 into a predetermined length for forming blades; a chute 57 serving as a discharge section for sending a blade formed in the cutting unit 55 to the blade accommodation section 34; and a band-shaped material sensor 65 disposed adjacent to the first feed unit 51 between the first and second feed units 51 and 52 and serving as a position detector for detecting the position of the band-shaped material 31.

The first feed unit 51 includes a pinch feeder 61 adapted to feed the band-shaped material 31 by pinching, and an air cylinder 62 serving as an actuator for driving the pinch feeder 61. The pinch feeder 61 includes rollers r11 and r12 serving as a pair of feed members and disposed rotatably and in such a manner as to vertically come into contact with and separate from each other, and a motor M3 serving as a feed drive for reversibly rotating one of the rollers r11 and r12, the roller r12 in the present embodiment. The air cylinder 62 is connected to the compressor C through a selector valve Va and drives the pinch feeder 61 through reception of compressed air from the compressor C so as to vertically move the roller r11.

When the roller r11 is moved to an upper position to thereby be separated from the roller r12, the feed passage for the band-shaped material 31 is opened; as a result, the band-shaped material 31 is not fed. When the roller r11 is moved to a lower position, the feed passage for the band-shaped material 31 is closed; as a result, the band-shaped material 31 is fed. When the motor M3 is driven in the positive direction, the band-shaped material 31 is moved forward toward the second feed unit 52, and, when the motor M3 is driven in the reverse direction, the band-shaped material 31 is moved backward.

When the band-shaped material 31 is set at the standby position in each of the gate sections gi, the plate 48*a* is moved to a lower position so as to grip the band-shaped material 31 between the plates 48*a* and 48*b*, and, in the first feed unit 51, the roller r11 is moved to the upper position to thereby open the feed passage for the band-shaped material 31. At this time, a tip 31*a* of the band-shaped material 31 is slightly protruded toward the second feed unit 52 from the contact position between the rollers r11 and r12.

The second feed unit 52 includes a pinch feeder 64 adapted to feed the band-shaped material 31 by pinching. The pinch feeder 64 includes rollers r13 and r14 serving as a pair of feed members and disposed rotatably, and a motor M4 serving as a feed drive for reversibly rotating one of the rollers r13 and r14, the roller r13 in the present embodiment.

When the first and second feed units 51 and 52 feed the band-shaped material 31, the encoder 53 detects the amount of feed of the band-shaped material 31.

The cutting unit 55 includes: a die 56 for cutting the band-shaped material 31; a motor M5 serving as a cutting drive for driving the die 56; and a motion converter 58 for converting a rotary motion of the motor M5 to a reciprocating motion. The die 56 includes a male die 56*a* and a female die 56*b*; the motion converter 58 includes a rotation transmission shaft sh2 threadingly engaged with an output shaft sh1 of the motor M5, and a cam 58*a* rotated by the rotation transmission shaft sh2; when the motor M5 is driven to rotate the output shaft sh1, the cam 58*a* is rotated through the rotation transmission shaft sh2 to thereby vertically move the male die 56*a*. The male die 56*a* moved to an upper position is separated from the female die 56*b*, and the male die 56*a* moved to a lower position enters the female die 56*b* to thereby cut the band-shaped material 31.

The blade accommodation section 34 includes a plurality of, 11 in the present embodiment, partition walls wb extending and standing in parallel with one another, and the partition walls wb define a plurality of, 10 in the present embodiment, groove-shaped accommodation chambers Si (i=1, 2, . . . , 10). The accommodation chambers Si accommodate blades formed by cutting the band-shaped materials 31 in the cutting unit 55, in such a manner as to assort the blades by type.

Next, a control device for the blade cutting device 30 will be described.

Figure 11:
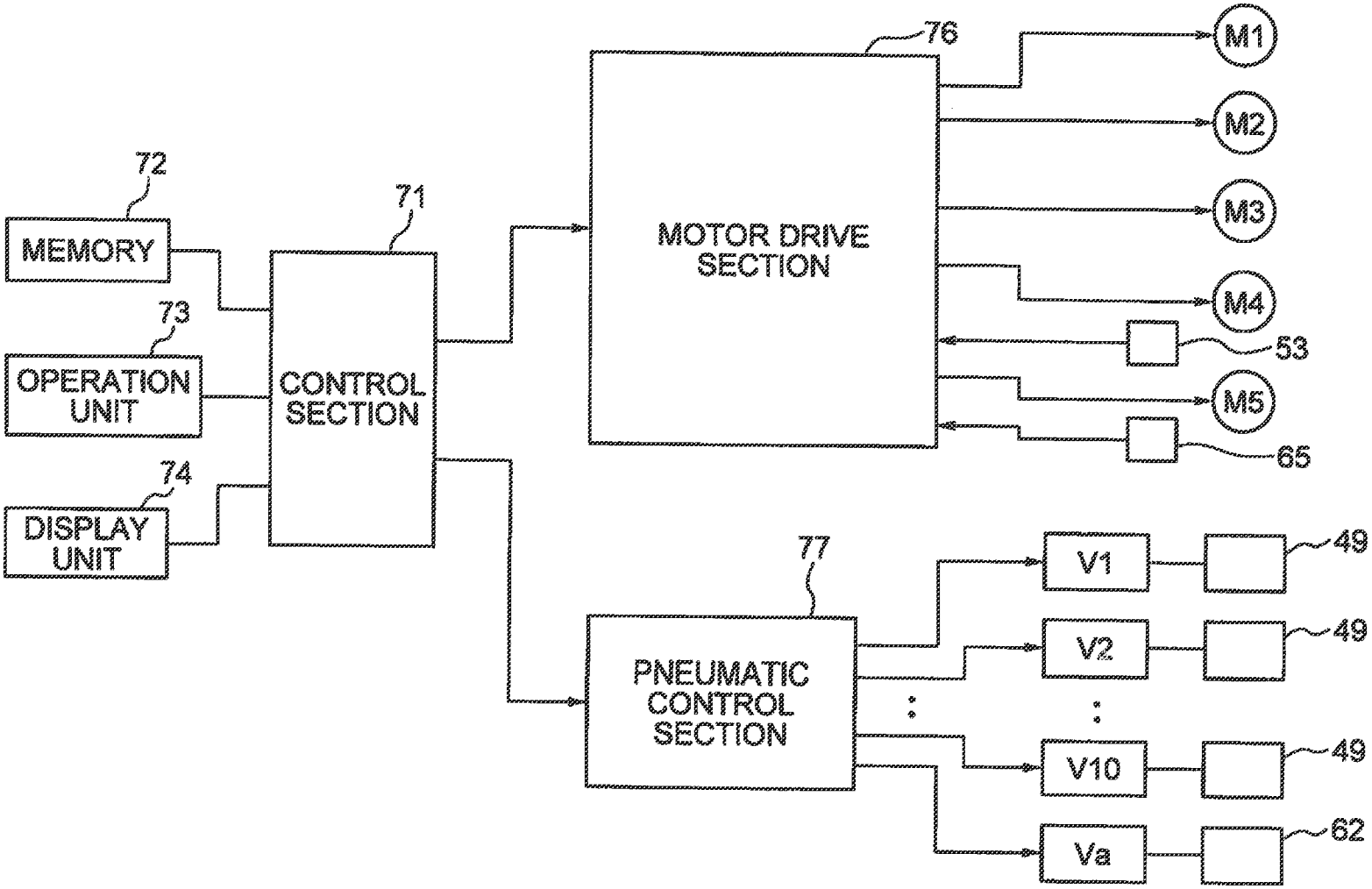
FIG. 11 Control block diagram of the blade cutting device in the embodiment of the present invention.

FIG. 11 is a control block diagram of the blade cutting device in the embodiment of the present invention.

In FIG. 11, 71 denotes a control section for controlling the entire blade cutting device 30; 72 denotes a memory serving as a storage; 73 denotes an operation unit composed of an operation panel, etc.; and 74 denotes a display unit composed of a liquid crystal panel, a display, etc. Also, 76 denotes a motor drive section for driving the motors M1 to M5; 53 denotes an encoder; 65 denotes a band-shaped material sensor; and 77 denotes a pneumatic control section for driving the air cylinders 49 and 62 through selective operation of the selector valves Vi and Va.

The encoder 53 is formed of a rotary encoder, includes a pair of rotary elements pinching the band-shaped material 31 (FIG. 1) therebetween and rotated by friction with the band-shaped material 31 as a result of feed of the band-shaped material 31, detects the amount of feed of the band-shaped material 31 on the basis of a rotation angle of the rotary elements, and sends a detection signal to the control section 71.

Incidentally, in the present embodiment, the amount of feed of the band-shaped material 31 is detected on the basis of a rotation angle of the motor M4. However, since the band-shaped material 31 is pulled out while the roll Cr is unrolled, in some cases, the band-shaped material 31 may slip and fail to be smoothly fed as a result of imposition of a large load on the motor M4 in the course of feeding the band-shaped material 31 by the second feed unit 52. In such a case, the amount of feed of the band-shaped material 31 cannot be detected accurately on the basis of a rotation angle of the motor M4; however, in the present embodiment, since the encoder 53 is disposed separately from the motor M4 and detects the amount of feed of the band-shaped material 31 on the basis of a rotation angle of the rotary elements rotated by friction with the band-shaped material 31, the amount of feed of the band-shaped material 31 can be detected accurately.

The band-shaped material sensor 65 detects the position of the band-shaped material 31 being fed between the first and second feed units 51 and 52 and sends a detection signal to the control section 71. In the present embodiment, whether or not the tip 31*a* of the band-shaped material 31 has reached between the rollers r13 and r14 of the pinch feeder 64 is judged from a sensor output of the encoder 53; however, whether or not the tip 31*a* of the band-shaped material 31 has reached between the rollers r13 and r14 of the pinch feeder 64 can also be judged on the basis of a detection signal of a band-shaped material sensor disposed adjacent to the second feed unit 52 on the downstream side of the second feed unit 52 with respect to the feed direction of the band-shaped material 31.

Next, the operation of the blade cutting device 30 will be described.

Figure 12:
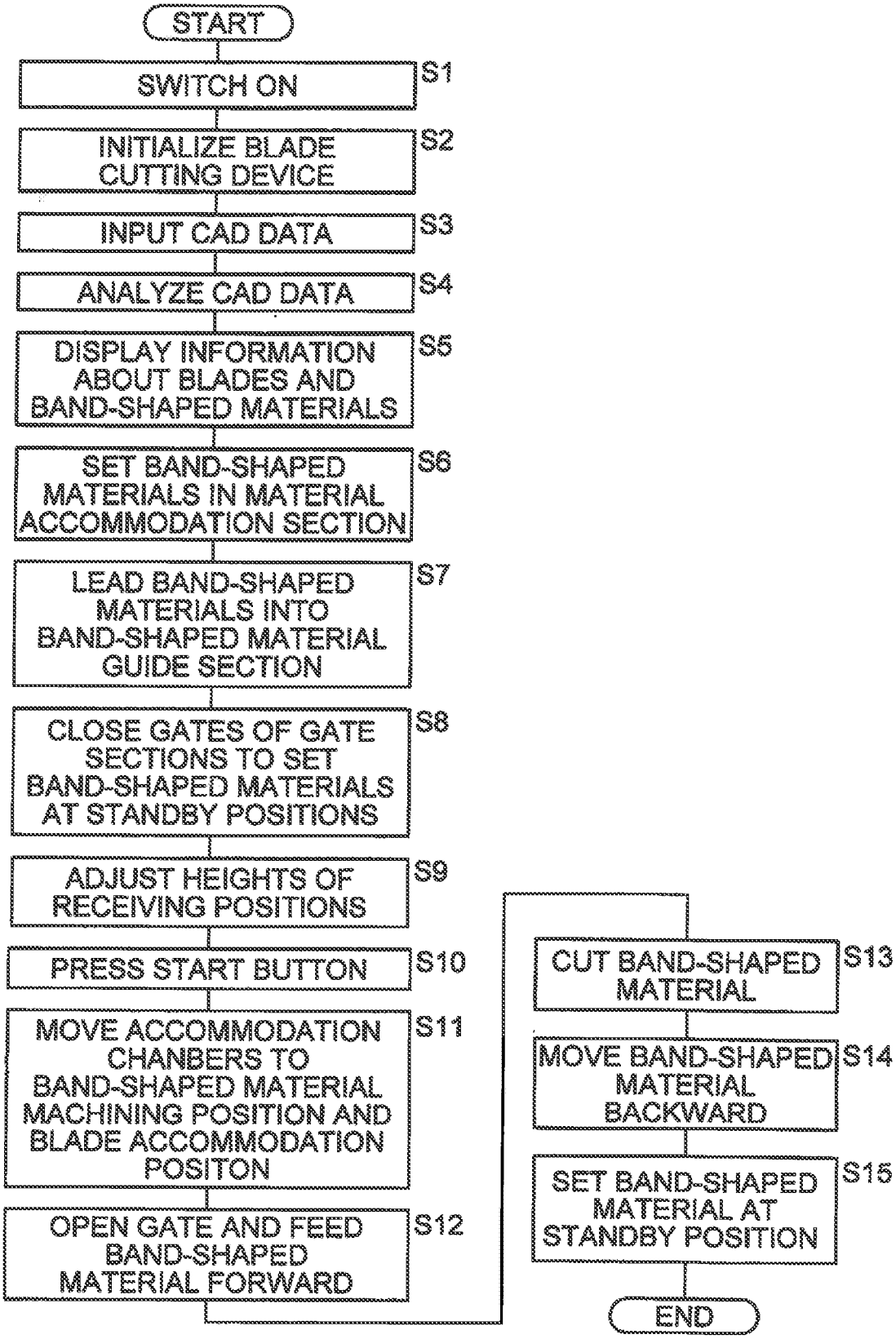
FIG. 12 Flowchart showing the operation of the blade cutting device in the embodiment of the present invention.

FIG. 12 is a flowchart showing the operation of the blade cutting device in the embodiment of the present invention.

First, when an operator switches on the blade cutting device 30 (step S1), the control section 71 initializes the blade cutting device 30 (step S2). At this time, in the band-shaped material guide section 41, the gates 48 of the gate sections gi are opened to thereby move the plates 48*a* to the upper positions. In the first feed unit 51, the rollers r11 and r12 of the pinch feeder 61 are stopped, and the roller r11 is moved to the upper position. In the second feed unit 52, the rollers r13 and r14 of the pinch feeder 64 are stopped. In the cutting unit 55, the male die 56*a* of the die 56 is moved to the upper position.

Next, when the operator operates the operation unit 73 (FIG. 11) of the blade cutting device 30 so as to input CAD data designed for stamping by the stamping machine 10 (FIG. 2) to the blade cutting device 30 (step S3), the control section 71 reads the CAD data into the memory 72. Subsequently, the control section 71 reads the CAD data from the memory 72 and analyzes the CAD data (step S4) so as to extract graphic data indicative of the shapes and dimensions of blades, calculates, on the basis of the graphic data, the colors, thicknesses, lengths, etc., of blades required in stamping by the stamping machine 10 so as to specify the band-shaped materials 31 required for forming the blades, and lists information about the blades and the band-shaped materials 31 such as the colors, thicknesses, and lengths of the blades, the names of the band-shaped materials 31, etc., on the display unit 74 (step S5).

Then, according to the list displayed on the display unit 74, the operator sets the rolls Cr of the band-shaped materials 31 in the respective accommodation chambers Ri of the material accommodation section 32 in accordance with the types of the band-shaped materials 31 (step S6), pulls out the band-shaped materials 31, and leads the band-shaped materials 31 into the band-shaped material guide section 41 (step S7). At this time, the tips 31*a* of the band-shaped materials 31 are slightly protruded toward the second feed unit 52 from the contact position between the rollers r11 and r12 of the first feed unit 51.

Subsequently, the control section 71 instructs the pneumatic control section 77 to perform switchover on the selector valves Vi for actuating the air cylinders 49 so as to close the gates 48; i.e., to move the plates 48*a* to the lower positions. As a result, the band-shaped materials 31 are set at the standby positions with their tips 31*a* protruding slightly from the contact position between the rollers r11 and r12 (step S8).

Next, the operator turns the knobs 47 of the position adjusting sections di for turning the screws 46 so as to vertically move the bars 45 and the rollers r3 for moving the rollers r3 to predetermined vertical positions in response to the intensities of curling of the band-shaped materials 31 to thereby adjust heights of receiving positions (step S9).

Subsequently, when the operator presses a start button on the operation unit 73 (step S10), the control section 71 instructs the motor drive section 76 to drive the motors M1 and M2 for moving the material accommodation section 32 in such a manner as to move a predetermined accommodation chamber Ri accommodating the roll Cr of the band-shaped material 31 to a position facing the band-shaped material machining section 33; i.e., to a band-shaped material machining position, and for moving the blade accommodation section 34 in such a manner as to move a predetermined accommodation chamber Si adapted to accommodate a blade formed by cutting the band-shaped material 31, to a position facing the band-shaped material machining section 33; i.e., to a blade accommodation position (step S11).

Then, the control section 71 instructs the pneumatic control section 77 to perform switchover on the selector valve Vi for opening the gate 48 of the gate section gi corresponding to the accommodation chamber Ri located at the band-shaped material machining position to thereby move the plate 48*a* to the upper position, and to perform switchover on the selector valve Va for moving the roller r11 of the first feed unit 51 to the lower position. Also, the control section 71 instructs the motor drive section 76 to drive the motors M3 and M4 in the positive direction for rotating the rollers r11 to r14. As a result, the band-shaped material 31 is fed forward by the first and second feed units 51 and 52 (step S12).

When the tip 31*a* of the band-shaped material 31 reaches the encoder 53, the encoder 53 starts to detect the amount of feed of the band-shaped material 31 and sends a detection signal to the control section 71.

On the basis of the detection signal received from the encoder 53, the control section 71 judges whether or not the tip 31*a* of the band-shaped material 31 has reached between the rollers r13 and r14. When the control section 71 judges that the tip 31*a* of the band-shaped material 31 has reached between the rollers r13 and r14, the control section 71 instructs the pneumatic control section 77 to perform switchover on the selector valve Va so as to move the roller r11 to the upper position and instructs the motor drive section 76 to stop driving the motor M3. Accordingly, since the pinch feeder 61 does not impose load on the second feed unit 52 while the second feed unit 52 feeds the band-shaped material 31, the band-shaped material 31 can be stably fed. As a result, a blade can be formed accurately.

The control section 71 obtains the amount of feed of the band-shaped material 31 on the basis of the detection signal from the encoder 53, and, when the amount of feed becomes equal to the length of a blade to be formed, the control section 71 instructs the motor drive section 76 to drive the motor M5 so as to cut the band-shaped material 31 by the die 56 (step S13).

A blade formed by cutting the band-shaped material 31 is discharged into the accommodation chamber Si located at the blade accommodation position through the chute 57.

Subsequently, the control section 71 instructs the motor drive section 76 to drive the motors M3 and M4 in the reverse direction so as to rotate the rollers r11 to r14 in the reverse direction. As a result, the band-shaped material 31 which has undergone cutting is moved backward by the first and second feed units Si and 52 (step S14).

When the band-shaped material sensor 65 detects the tip 31*a* of the band-shaped material 31 and sends a detection signal to the control section 71, the control section 71 instructs the motor drive section 76 to stop driving the motors M3 and M4. Also, the control section 71 instructs the pneumatic control section 77 to perform switchover on the selector valve Vi so as to close the gate 48 of the gate section gi; i.e., to move the plate 48*a* to the lower position, and instructs the pneumatic control section 77 to perform switchover on the selector valve Va so as to move the roller r11 of the pinch feeder 61 in the first feed unit 51 to the upper position. By this procedure, the band-shaped material 31 is set at the standby position (step S15).

In the present embodiment, as shown in FIG. 1, the rolls Cr of the band-shaped materials 31 are set respectively in the accommodation chambers R1 and R3 of the material accommodation section 32, and the tips 31*a* of the band-shaped materials 31 pulled out from the accommodation chambers R1 and R3 are slightly protruded toward the second feed unit 52 from the contact position between the rollers r11 and r12 (FIG. 4) of the first feed unit 51, whereby the band-shaped materials 31 are set at their standby positions.

When the operator presses the start button on the control section 73 (FIG. 11), the motors M1 and M2 are driven so as to move the accommodation chamber R3 of the material accommodation section 32 to the band-shaped material machining position, and the accommodation chamber S3 of the blade accommodation section 34 is moved to the blade accommodation position.

Subsequently, in the band-shaped material guide section 41, the gate 48 of the gate section g3 corresponding to the accommodation chamber R3 located at the band-shaped material machining position is opened to thereby move the plate 48*a* to the upper position. In the band-shaped material machining section 33, the roller r11 of the pinch feeder 61 is moved to the lower position, and the motors M3 and M4 are driven in the positive direction to thereby rotate the rollers r11 to r14. As a result, the band-shaped material 31 pulled out from the accommodation chamber R3 is fed forward by the first and second feed units 51 and 52.

When the tip 31*a* of the band-shaped material 31 reaches the encoder 53, the encoder 53 starts to detect the amount of feed of the band-shaped material 31. When the amount of feed of the band-shaped material 31 becomes equal to the length of a blade, the motor M5 is driven so as to cut the band-shaped material 31, by the die 56, into a dimension specified in the graphic data. A blade formed through cutting is discharged into the accommodation chamber S3 located at the blade accommodation position through the chute 57.

Subsequently, the motors M3 and M4 are driven in the reverse direction to thereby rotate the rollers r11 to r14 accordingly, whereby the band-shaped material 31 is moved backward by the first and second feed units 51 and 52. When the band-shaped material sensor 65 detects the tip 31*a* of the band-shaped material 31, the motors M3 and M4 are stopped to thereby stop the rollers r11 to r14, and the gate 48 of the gate section g3 is closed, thereby setting the band-shaped material 31 at the standby position.

As mentioned above, in the present embodiment, the band-shaped materials 31 of different types are respectively accommodated in the accommodation chambers Ri of the material accommodation section 32; a predetermined one of the accommodation chambers Ri is located at the band-shaped material machining position facing the band-shaped material machining section 33; and the band-shaped material 31 pulled out from the predetermined accommodation chamber is fed by the first and second feed units 51 and 52 and cut into a predetermined length by the cutting unit 55 so as to form a blade.

Therefore, the work of selecting the band-shaped material 31 from a large number of types of the band-shaped materials 31 for forming blades can be simplified, and the blade can be formed accurately.

A predetermined one of the accommodation chambers Si of the blade accommodation section 34 is located at the blade accommodation position facing the band-shaped material machining section 33, and a blade formed by the cutting unit 55 is discharged into the predetermined accommodation chamber. Therefore, blades of different types corresponding to the band-shaped materials 31 of different types can be accommodated in such a manner as to be sorted by type.

Accordingly, since blades taken from the accommodation chambers Si can be accurately embedded in respective grooves of a stamping die, blanks can be formed accurately.

In the present embodiment, a single band-shaped material machining section 33 is disposed between the material accommodation section 32 and the blade accommodation section 34. However, a plurality of; for example, two band-shaped material machining sections 33, can be disposed in parallel between the material accommodation section 32 and the blade accommodation section 34. In such a case, two of the band-shaped materials 31 received in the band-shaped material guide section 41 are guided to the respective band-shaped material machining sections 33.

In the present embodiment, the air cylinders 49 and 62 are used as the actuators. However, oil hydraulic cylinders, motors, or the like can be used in place of the air cylinders 49 and 62.

DESCRIPTION OF REFERENCE NUMERALS

26: stamping blade
27: ruling blade
30: blade cutting device
31: band-shaped material
32: material accommodation section
33: band-shaped material machining section
51, 52: first and second feed units
55: cutting unit
71: control section
Ri: accommodation chamber

The invention claimed is:

1. A blade cutting device characterized by comprising:

(a) a material accommodation section comprising a plurality of accommodation chambers for respectively accommodating different types of band-shaped materials used to form blades;

(b) a band-shaped material machining section comprising a feed unit for feeding a band-shaped material pulled out from a predetermined one of the plurality of accommodation chambers and a cutting unit for producing formed blades by cutting the fed band-shaped material into a predetermined length;

(c) a blade accommodation section linearly movable relative to the band-shaped material machining section and comprising a plurality of blade accommodation chambers for respectively receiving the formed blades in such a manner as to be sorted by type; and (d) a control section for controlling the material accommodation section to linearly move so as to locate the predetermined accommodation chamber of the material accommodation section at a position facing the band-shaped material machining section, and for controlling the blade accommodation section to linearly move so as to locate a predetermined one of the blade accommodation chambers at a position facing the band-shaped material machining section, the material accommodation section being moved synchronously with the blade accommodation section to correlate a predetermined accommodation chamber with a predetermined material accommodation chamber.

2. A blade cutting device according to claim 1, wherein the material accommodation section comprises a band-shaped material guide section for receiving the band-shaped materials pulled out from the accommodation chambers of the material accommodation section and for uncurling the band-shaped materials and for feeding the band-shaped material to the band-shaped material machining section.

3. A blade cutting device according to claim 2, wherein the band-shaped material guide section comprises uncurling sections disposed in such a manner as to correspond to the accommodation chambers of the material accommodation section and adapted to uncurl the band-shaped materials.

4. A blade cutting device according to claim 3, wherein the uncurling sections are composed of a plurality of rollers disposed along a feed direction of the band-shaped materials.

5. A blade cutting device according to claim 4, wherein the band-shaped material guide section comprises position adjusting sections for adjusting the positions of predetermined ones of the plurality of rollers.

6. A blade cutting device according to claim 2, wherein the band-shaped material guide section comprises gate sections disposed in such a manner as to correspond to the accommodation chambers of the material accommodation section and adapted to grip and set the band-shaped materials pulled out from the accommodation chambers at respective standby positions.

* * * * *